US005547195A

United States Patent [19]

Callanan

[11] Patent Number: 5,547,195

[45] Date of Patent: Aug. 20, 1996

[54] GOLF SWING TRAINING DEVICE AND METHOD

[76] Inventor: Sean P. Callanan, 3824 Malec Cir., Sarasota, Fla. 34233

[21] Appl. No.: 372,978

[22] Filed: Jan. 17, 1995

[51] Int. Cl.[6] ..... A63B 69/36

[52] U.S. Cl. ..... 473/227

[58] Field of Search ..... 273/35 R, 187.2, 273/188 R, 189 R, 187 R, 424, 425, 426, 427

[56] References Cited

U.S. PATENT DOCUMENTS

| | | | |
|---|---|---|---|
| D. 86,590 | 3/1932 | Adams | 273/425 |
| 2,506,932 | 5/1950 | McAfee | 273/425 |
| 3,083,016 | 3/1963 | Sumegi | 273/35 R |
| 4,063,382 | 12/1977 | McCallum | 273/425 |
| 4,265,454 | 5/1981 | Bayless | 273/427 |
| 4,591,164 | 5/1986 | Blight | 273/426 |
| 4,979,922 | 12/1990 | Clark | 273/424 |
| 5,294,126 | 3/1994 | Armstrong, III | 273/187.2 |

*Primary Examiner*—Mark S. Graham
*Attorney, Agent, or Firm*—Charles J. Prescott

[57] ABSTRACT

A golf swing training device and method, the device including opposing right-hand and left-hand gripping portions or areas of a frame or circular disc. The gripping portions are spaced apart a distance somewhat equal to the golfer's waist width so that the arms are correctly positionable as in a proper golf stance and swing. A preferred angular orientation of the gripping portions one to another is about 135° and may be in the range of about 90° to 180°. By firmly grasping each gripping portion with the device positioned in front of the golfer similar to that of a golf club, the device may now be swung and properly rotated during an entire practice golf swing to accurately simulate the hand, arm and body movement of a proper golf swing. Viewable arrow indicia positioned centrally on an obverse surface of the device viewably advises the golfer of the proper rotational orientation at each stage of the swing.

9 Claims, 2 Drawing Sheets

Fig 5
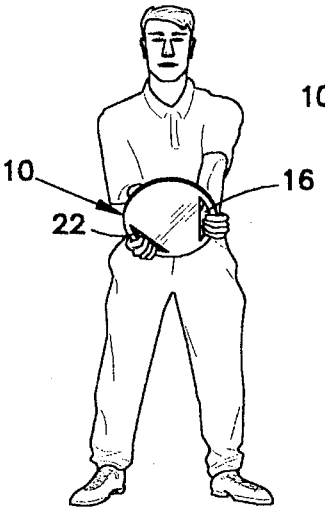
Fig 6
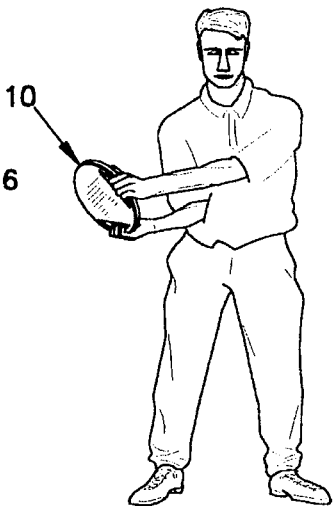
Fig 7
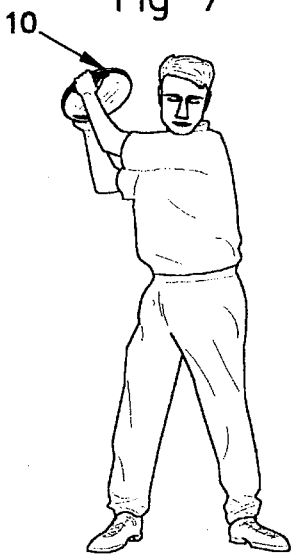
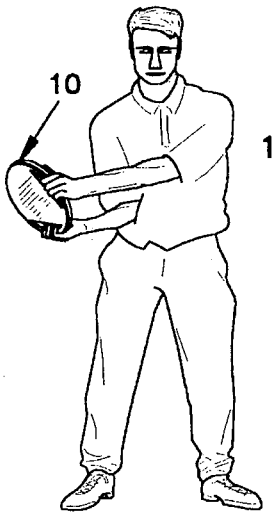
Fig 8
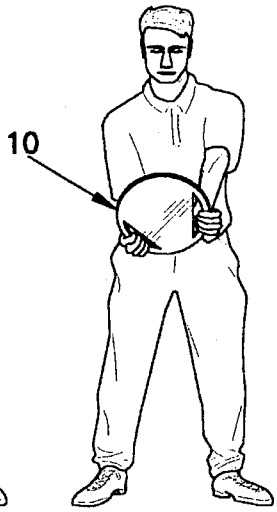
Fig 9
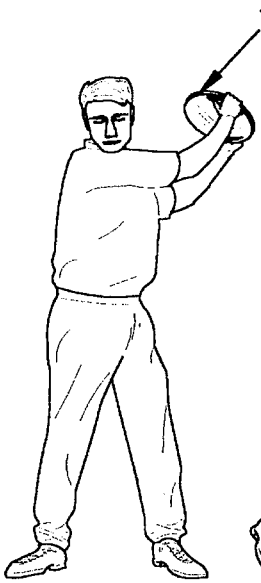
Fig 10
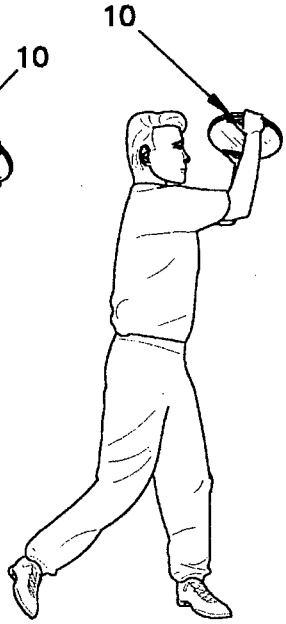
Fig 11

GOLF SWING TRAINING DEVICE AND METHOD

BACKGROUND OF THE INVENTION

1. Scope of Invention

This invention relates generally to devices for teaching and practicing a proper golf swing, and more particularly to a hand-grippable device in lieu of a golf club which both teaches proper stance and swing and facilitates the practice thereof.

2. Prior Art

Because a proper golf swing is such an unnatural movement which, when done properly, causes the head of the golf club to swing in a pendulum motion striking the golf ball so as not to impart any spin for straight flight, many golf swing practice devices of various kinds have been developed in the past.

A number of such practice or training devices are related to engagement with, and movement control with respect to the waist area of the golfer. One such device is disclosed in U.S. Pat. No. 5,358,250 invented by Spencer. Another such device invented by Lopez is shown in U.S. Pat. No. 4,688,300. Other body or torso engaging golf swing practice or training devices ar disclosed in the following U.S. Pat. Nos:

| | |
|---|---|
| Redfield | 2,773,691 |
| Topping | 3,069,169 |
| Strong | 4,691,924 |

A number of additional prior art devices focus on interengagement with or between one or both arms of the user so as to correctively modify the arm movement during the practice golf swing. These patents are shown by example as follows:

| | |
|---|---|
| Davis | 1,655,092 |
| Vickers | 3,415,524 |
| Norman et al. | 4,239,228 |
| Owens | 4,245,841 |

To demonstrate the extremes to which golfers will go to improve the golf swing, Angshed, in U.S. Pat. No. 4,173,344, teaches a golf swing training device and method having an arcuate guide member which is generally circular in nature supported atop the ground by a ground-engaging frame and dimensioned and supported to extend along and control the entire path of travel of the golfer's hands through a fully executed golf swing.

The present invention provides an extremely simple to manufacture and easily carried and used device and method of use for rapidly improving the golf swing and for repeated practice thereof.

BRIEF SUMMARY OF THE INVENTION

This invention is directed to a golf swing training device and method, the device including opposing right-hand and left-hand gripping portions or areas of a frame or circular disc. The gripping portions are spaced apart a distance somewhat equal to the golfer's waist width so that the arms are correctly positionable as in a proper golf stance and swing. A preferred angular orientation of the gripping portions one to another is about 135° and may be in the range of about 90° to 180°. By firmly grasping each gripping portion with the device positioned in front of the golfer similar to that of a golf club, the device may now be swung and properly rotated during an entire practice golf swing to accurately simulate the hand, arm and body movement of a proper golf swing. Viewable arrow indicia positioned centrally on an obverse or golfer-facing surface of the device viewably advises the golfer of the proper rotational orientation at each stage of the swing.

It is therefore an object of this invention to provide an easily transportable, light-weight, hand-holdable golf swing training device which is held and swung in lieu of a golf club.

It is yet another object of this invention to provide a golf swing training device which facilitates, by gripping portion spacing and angular orientation, the practice of a proper golf swing.

It is yet another object of this invention to provide a golf swing training device which includes viewable indicia thereon to assist the golfer in proper rotational orientation of the device during practice golf swings.

It is yet another object of this invention to provide a method of training and practicing a proper golf swing.

In accordance with these and other objects which will become apparent hereinafter, the instant invention will now be described with reference to the accompanying drawings.

BRIEF DESCRIPTION OF THE DRAWINGS

FIG. 5 is a perspective view showing a golfer holding the device of FIG. 1 in a proper initial or golf ball address stance.

FIG. 6 is a perspective view similar to FIG. 5 depicting the golfer commencing a back swing.

FIG. 7 is a perspective view of similar to FIG. 5 showing the golfer at the top of the back swing.

FIG. 8 is a perspective view similar to FIG. 5 showing the golfer in the middle of the downswing.

FIG. 9 is a perspective view similar to FIG. 5 showing the golfer at the approximate point of simulated golf ball impact.

FIG. 10 is a perspective view similar to FIG. 5 showing the golfer partially through the follow-through swing.

FIG. 11 is a perspective view similar to FIG. 5 showing the golfer at the end of the golf swing.

DETAILED DESCRIPTION OF THE INVENTION

Figure 1:
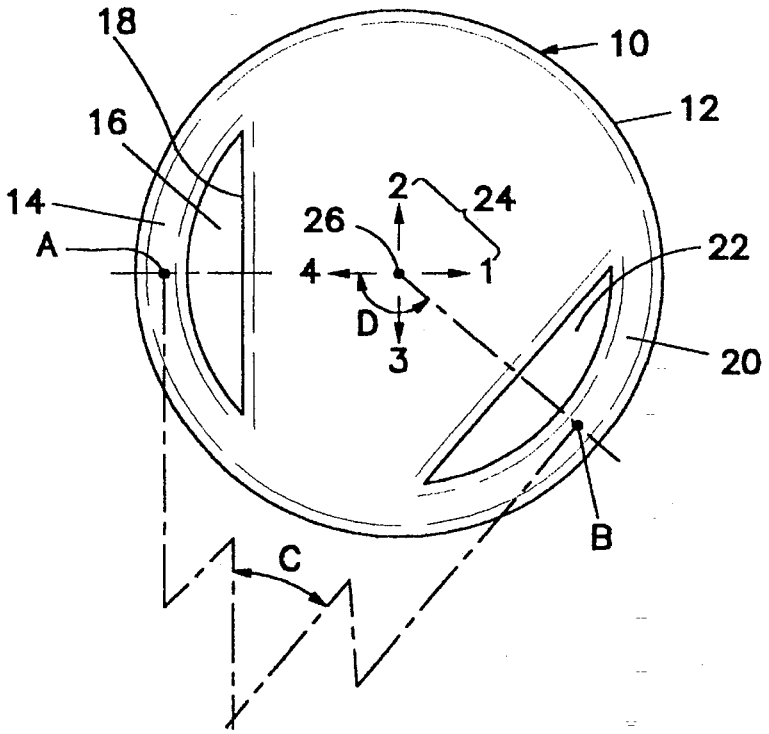
FIG. 1 is a top plan view of an obverse face of the preferred embodiment of the invention.
Figure 2:
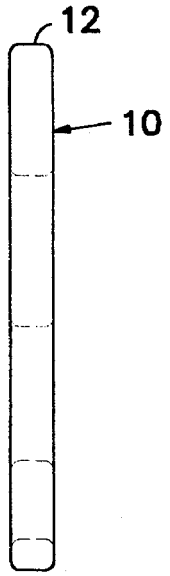
FIG. 2 is a side elevation view of FIG. 1.

Referring now to the drawings, and particularly to FIGS. 1 and 2, the preferred embodiment of the invention is shown generally at numeral 10 and includes a circular, flat disc-shaped member 12 formed of wood or molded plastic material. The disc 12 includes two arcuate slots 16 and 22 opposingly positioned adjacent and extending along two portions of a circular perimeter of disc 12 as shown. These slots 16 and 22 define gripping portions 14 and 20, the central or mid-points A and B of which correspondingly define the approximate center of a normal hand gripping position of a golfer using the device 10.

By projecting points A and B tangentially with respect to the circular perimeter of disc 12, the angular orientation of the mid-points A and B is defined by angle C therebetween. This angle C is preferably about 135° and may be in the range of 90° to 180° thus placing slot 22 and gripping portion 20 in a range as viewed in FIGS. 1 from approximately 6 o'clock or opposing numeral 3 to approximately 3 o'clock opposing numeral 1.

An alternate means for defining the angular orientation with respect to the left-hand and right-hand gripping portions 14 and 20, respectively, is shown by angle D representing the angular relationship between the radial projection from mid-points A and B through the geometric center 26 of the disc 12. Again, this angle D may be in the range of 90° to 180° and preferably is chosen to be 135° which is shown to produce best overall golf swing training and practice results.

To assist the golfer further, viewable arrow indicia 24 is also applied to the obverse surface of disc 12, the obverse surface being that surface which faces the golfer when the device 10 is properly held as described herebelow and with respect to FIGS. 5 to 11. This indicia 24 includes four orthogonally oriented arrows and numerals 1 to 4 representing the sequence or stages of movement of the device 10 and the proper direction of movement as indicated by the corresponding arrow that a proper swing should take while holding the device 10.

Thus, numeral 1 and the arrow associated therewith represents the direction of the movement 10 of the device at practice tee-up and during the back swing or initial swing stage. Numeral 2 and the associated arrow therewith viewably advises the golfer of the direction that the device 10 should take and the associated proper rotational orientation thereof during the upswing. Thus, the device 10 should be rotated through approximately 90° during the upswing portion of the golf swing.

Numeral 3 and the arrow associated therewith viewably advise the golfer of the direction and angular orientation of the device 10 during the downswing, while numeral 4 and the arrow associated therewith so advise the golfer of the direction and rotational orientation of the device 10 during the through ball and upswing stages of the practice golf swing.

METHOD OF USE

The stages of use of the device are depicted perspectively in FIGS. 5 to 11. In FIG. 5, the golfer is shown in a static position as he would be addressing a golf ball while holding the device 10. Note that slot 16 is orientated so that its straight inner edge 18 is generally upright and so that numeral 1 and the corresponding arrow would be directed to his immediate generally orthogonal right.

In FIG. 6, the device 10 is shown held by the golfer in the upswing portion of the back stroke. In this position, numeral 2 and the arrow associated therewith viewably advise the golfer as to the proper direction and angular orientation of the device 10 as shown.

In FIG. 7, the device 10 is shown at the top of the back swing, numeral 3 of the indicia 24 and the associated arrow, indicating the new direction and angular orientation of the device as the downswing is about to be commenced. In FIG. 8, the downswing is in progress and in FIG. 9, the device 10 is shown at the approximate point of imaginary golf ball impact.

In FIG. 10, the device 10 is shown being swung by the golfer midway through the follow-through portion of the swing and in FIG. 11, the device 10 is depicted at the end of the golf swing.

ALTERNATE EMBODIMENT

Figure 3:
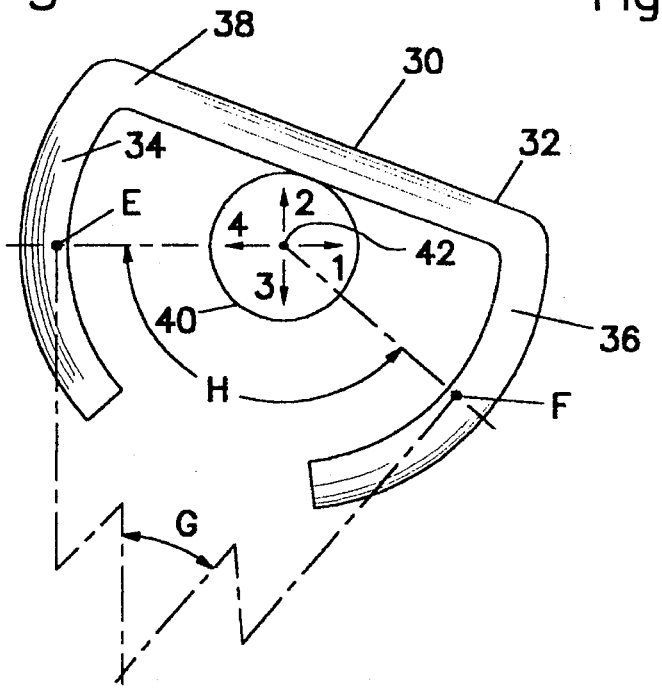
FIG. 3 is a top plan view of an obverse surface of another embodiment of the invention.
Figure 4:
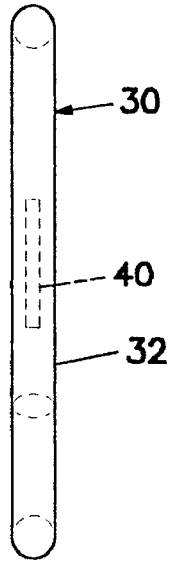
FIG. 4 is a side elevation view of FIG. 3.

An alternate embodiment of the invention is shown in FIGS. 3 and 4 generally at numeral 30. This embodiment 30 includes a formed elongated metal or plastic frame 32 formed of cylindrical bar stock material. This rigid frame 32 includes a generally straight central portion 38 and two arcuately formed griping portions 34 and 36 disposed from each end thereof. By comparing the positioning and arcuate shape of the gripping portions 34 and 36 with the gripping portions 14 and 20 shown in FIG. 1, the overall similarities will be self-evident.

As described with respect to the embodiment 10 in FIG. 1, these gripping portions 34 and 36 have their central or mid-portions E and F angularly oriented one to another at an inclusive angle G therebetween. This angle G is preferably about 135° and may be in the range of 90° to 180°.

Alternately described, the relative angular orientation of points E and F about the geometric center 42 of the device 30 is defined by angle H. This angle H again is preferably in the range of about 135° but may lie between 90° and 180° to fall within the scope of this invention.

This embodiment 30 also preferably provides a viewable indicia 40 connected centrally about the geometric center of the device 30. As previously described, this viewable indicia 40 provides for directional arrows generally orthogonally orientated one to another and the associated numerical sequencing thereof to advise the golfer of the proper swing direction and angular orientation of the device 30 during each stage of the practice golf swing.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A golf swing training device comprising:

a circular disc having two spaced apart arcuate slots formed through said disc and positioned in close proximity to, and extending along, a portion of a perimeter of said disc;

said slots cooperatively sized and positioned with respect to said perimeter portion to define a right-hand and a left-hand arcuate gripping portion along and defining a portion of said perimeter;

said gripping portions angularly oriented one to another at an angle of between about 135° and 180° with respect to, and generally concentric about, a geometric center of said disc;

said disc having an overall size for allowing a golfer to hold and practice swing said disc similar to that of a golf club.

2. A golf swing training device as set forth in claim 1, further comprising:

viewable indicia means disposed on an obverse surface of said disc for instructing a golfer as to a proper rotational orientation of said disc during each stage of each golf swing.

3. A golf swing training device as set forth in claim 2, wherein:

said left-hand gripping portion is positioned uprightly on a left-hand side of said indicia means.

4. A golf swing training device comprising:

a rigid frame having a generally open center portion and spaced apart right-hand and left-hand gripping portions;

said gripping portions defining a perimeter of said device and angularly oriented one to another an included angle in the range of about 90° to 180° between said gripping portions;

said right-hand and said left-hand gripping portions spaced apart and sized in length for being held by a golfer during each practice swing; and viewable indicia means disposed on an obverse side of said frame for instructing a golfer as to a proper rotational orientation of said disc during each stage of a golf swing.

5. A golf swing training device as set forth in claim 4, wherein:

said left-hand gripping portion is positioned uprightly on a left-hand side of said indicia means.

6. A golf swing training device as set forth in claim 4, wherein:

said angle is about 135°.

7. A method of golf swing training comprising the steps of:

A. providing a golf swing training device comprising:

a rigid frame having spaced apart right-hand and left-hand gripping portions;

said gripping portions angularly oriented one to another an included angle in the range of about 90° to 180° between said gripping portions;

said right-hand and said left-hand gripping portions spaced apart and sized in length for being held by a golfer during each practice swing.

B. gripping said right-hand and said left-hand gripping portions with the corresponding right and left hands of the golfer;

C. positioning said device in front of the golfer similar to that of a golf club;

D. swinging said device through a practice golf swing.

8. A method of golf swing training as set forth in claim 7, further comprising the steps of:

E. maintaining a proper rotational orientation of said device at the onset of, and during the golf swing by a proper rotational alignment of a viewable arrow indicia disposed on an obverse surface of said frame.

9. A golf swing training device consisting essentially of:

a rigid frame having spaced apart right-hand and left-hand gripping portions;

said gripping portions angularly oriented one to another an included angle in the range of about 135° between the center of said gripping portions;

said right-hand and said left-hand gripping portions spaced apart and sized in length for being held by a golfer during each practice swing.

* * * * *